US006454264B1

(12) United States Patent
Aiello

(10) Patent No.: US 6,454,264 B1
(45) Date of Patent: Sep. 24, 2002

(54) LOTTERY BOARD GAME

(76) Inventor: Anthony S. Aiello, 4461 Marlin Ct., Spring Hill, FL (US) 34606

( * ) Notice: Subject to any disclaimer, the term of this patent is extended or adjusted under 35 U.S.C. 154(b) by 0 days.

(21) Appl. No.: 09/880,501

(22) Filed: Jun. 12, 2001

Related U.S. Application Data

(60) Provisional application No. 60/272,529, filed on Mar. 1, 2001.

(51) Int. Cl.[7] ..... A63F 3/06

(52) U.S. Cl. ..... 273/274; 273/269

(58) Field of Search ..... 273/274, 269, 273/270, 139; 283/901, 903

(56) References Cited

U.S. PATENT DOCUMENTS 4,591,162 A 5/1986 Fakhoury ..... 273/303
4,655,461 A * 4/1987 Capri et al.
4,741,540 A 5/1988 Levine ..... 273/292
4,874,178 A 10/1989 Gage ..... 273/274
5,232,221 A 8/1993 Sludiloff ..... 273/139
5,269,523 A * 12/1993 Boylan et al.
5,273,281 A * 12/1993 Lovell
5,718,432 A 2/1998 Fraser ..... 273/304
5,836,816 A * 11/1998 Bruin et al.

* cited by examiner

*Primary Examiner*—William M. Pierce
(74) *Attorney, Agent, or Firm*—Joseph N. Breaux

(57) ABSTRACT

A board game having many of the elements of a lottery utilized to obtain one or more individuals. The game is played by the players filling in a card by selecting a number of numbers and then activating a random number generating device which outputs a display. Players are rewarded points according to the number of matching numbers appearing on the cards when they appear on the random number generating device display. Play continues until one player reaches a predetermined winning score or a player achieves a win by matching all six of the numbers generated by the random generating device.

1 Claim, 1 Drawing Sheet

LOTTERY BOARD GAME

This application claims the benefit of Provisional application No. 60/272,529, filed Mar. 1, 2001.

TECHNICAL FIELD

The present invention relates to board games and the like and more particularly to a lottery based board game that includes a number of cards each having separate areas with numbers provided thereon for choosing by the player; a random number generating device having an output display, and a master score sheet that allows the individuals to keep score according to a scoring table wherein a person picking: six out of six numbers is the automatic winner of the game; five out of six number scores 250 points, four out of six number scores 100 points, three out of six numbers scores 50 points, two out of six numbers scores 25 points, one out of six numbers scores 20 points and zero out of six numbers causes a penalty of minus five points; players continue playing lottery hands until a predetermined winning score is reached by one of the players or a winner is achieved by matching six out of six numbers.

BACKGROUND OF INVENTION

Many individuals enjoy playing games as a method of passing the time and interacting with other people. Because many people play the lottery, it would be desirable to have a board game that included many of the elements that are included in the lottery so that the individuals can experience multiple lottery hands while playing the board game.

SUMMARY OF INVENTION

It is thus an object of the invention to provide a lottery board game that includes a number of cards each having separate areas with numbers provided thereon for choosing by the player; a random number generating device having an output display, and a master score sheet that allows the individuals to keep score according to a scoring table wherein a person picking: six out of six numbers is the automatic winner of the game; five out of six number scores 250 points, four out of six number scores 100 points, three out of six numbers scores 50 points, two out of six numbers scores 25 points, one out of six numbers scores 20 points and zero out of six numbers causes a penalty of minus five points; players continue playing lottery hands until a predetermined winning score is reached by one of the players or a winner is achieved by matching six out of six numbers.

Accordingly, a lottery board game is provided. The lottery board game includes a number of cards each having separate areas with numbers provided thereon for choosing by the player; a random number generating device having an output display, and a master score sheet that allows the individuals to keep score according to a scoring table wherein a person picking: six out of six numbers is the automatic winner of the game; five out of six number scores 250 points, four out of six number scores 100 points, three out of six numbers scores 50 points, two out of six numbers scores 25 points, one out of six numbers scores 20 points and zero out of six numbers causes a penalty of minus five points; players continue playing lottery hands until a predetermined winning score is reached by one of the players or a winner is achieved by matching six out of six numbers.

BRIEF DESCRIPTION OF DRAWINGS

For a further understanding of the nature and objects of the present invention, reference should be had to the following detailed description, taken in conjunction with the accompanying drawings, in which like elements are given the same or analogous reference numbers and wherein.

EXEMPLARY EMBODIMENTS

Figure 1:
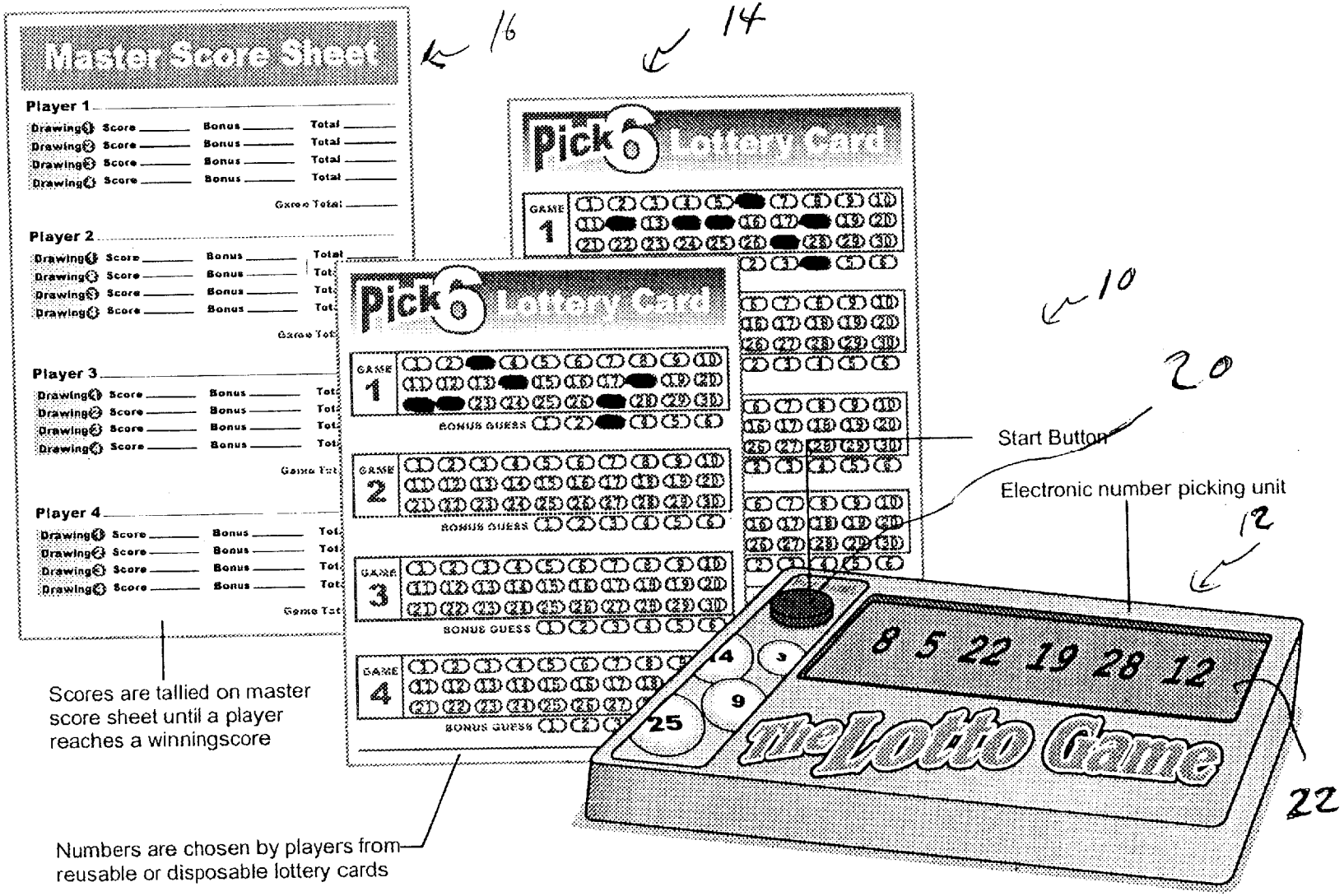
FIG. 1 is a perspective view of the game playing elements of the lottery board game of the present invention

FIG. 1 shows various aspects of an exemplary embodiment of the lottery board game of the present invention generally designated 10. Lottery board game elements 10 include a random number generating device generally designated 12, a number of number picking cards 14 and a master score sheet 16. During each hand of play, the player blocks six of the number in each of the game area with his/her selected numbers one of the players then presses the start button 20 of random generator 12 which then outputs six numbers on the display screen 22. Each player is then awarded points according to the following point schedule including 250 points for picking five out of the six numbers; 100 points for picking four of the six numbers; 50 points for picking three of the six numbers; 25 points for picking two of the six numbers; 20 points for picking one of the six numbers and a automatic win for picking all six of the six numbers.

It can be seen from the preceding description that a lottery board game has been provided.

It is noted that the embodiment of the lottery board game described herein in detail for exemplary purposes is of course subject to many different variations in structure, design, application and methodology. In particular, the random number generator may include any mechanism or method for determining six numbers including but not limited to mechanisms and methods such as: bingo ball type systems, mechanical spinners with pointers that point at numbers arranged in a ring around the perimeter of a circle defined by the end of the pointer that are spun until the designated number of numbers have been pointed to, and a deck of cards with the numbers printed thereon that are shuffled and then the desired number of cards removed and turned over. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A lottery board game playing method comprising the steps of:

a) a providing lottery board game set that includes a number of cards each having separate areas with numbers provided thereon for choosing by the player, a random number generating device, and a master score sheet that allows the individuals to keep score according to a scoring table wherein a person picking: six out of six numbers is the automatic winner of the game; five out of six number scores 250 points, four out of six number scores 100 points, three out of six numbers scores 50 points, two out of six numbers scores 25 points, one out of six numbers scores 20 points and zero out of six numbers causes a penalty of minus five points;

b) setting a predetermined winning point score;

c) providing each of the players with a card;

d) allowing each player to indicate on his/her card six numbers chosen by the player for a particular game;

e) operating the random number generating device to generate six generated numbers;

f) comparing each player's chosen numbers with the six generated numbers and awarding each player a score according to the scoring criteria in step a);

g) calculate each player's total score to evaluate if any player has reached the predetermined winning point score; and h) repeating steps d), e), f), g) and h) until a winner is determined either by a player achieving the predetermined winning point score or by a player having chosen six numbers that match the six generated numbers.

* * * * *